United States Patent [19]

Hawkinson et al.

[11] Patent Number: 4,898,282

[45] Date of Patent: Feb. 6, 1990

[54] MERCHANDISE DISPLAY RACK

[76] Inventors: Rodney B. Hawkinson, 1919 Valencia St., Napa, Calif. 94558; Julius A. Sarto, 383 N. Autumn St., San Jose, Calif. 95110

[21] Appl. No.: 223,101

[22] Filed: Jul. 22, 1988

[51] Int. Cl.[4] ..... A47F 7/00

[52] U.S. Cl. ..... 211/49.1; 211/59.3

[58] Field of Search ..... 211/59.3, 59.2, 49.1, 211/15, 162; 312/71, 45

[56] References Cited

U.S. PATENT DOCUMENTS

| | | | |
|---|---|---|---|
| 1,185,793 | 6/1916 | Hanson | 211/59.3 X |
| 2,094,765 | 10/1937 | Barnes | 211/59.3 |
| 2,212,129 | 8/1940 | Rust | 211/59.2 X |
| 2,604,996 | 7/1952 | Smith | 211/59.3 |
| 3,082,876 | 3/1963 | Cranmore | 211/59.3 |
| 3,738,722 | 6/1973 | Kooiman | 211/59.3 X |
| 4,144,662 | 3/1979 | Drexler | 211/59.2 X |

*Primary Examiner*—Ramon S. Britts
*Assistant Examiner*—Sarah A. Lechok
*Attorney, Agent, or Firm*—Melvin R. Stidham

[57] ABSTRACT

The merchandise display rack of this invention is particularly adapted for cylindrical ice cream containers. Each rack in the assembly has in-turned side rails so that a row of containers can be supported on their cylindrical sides and fed forwardly by a pusher plate pressing against the trailing container. A stretchable tension member, such as a long coil spring, is attached to the rear of each rack at both sides, brought forward around spaced pulleys at the front and then directed back behind the pusher plate that engages the trailing container. The individual racks may be secured together side by side and vertically with sufficient vertical clearance to accommodate a row of containers.

8 Claims, 3 Drawing Sheets

MERCHANDISE DISPLAY RACK

BACKGROUND OF THE INVENTION

This invention relates to a merchandise display rack, and particularly to a display rack wherein a row of containers is displayed and caused to move forward automatically as the front container is removed, thus continuously presenting a container at the front of the shelf in clear view and readily accessible. A display rack of this general type is described and claimed in our previous U.S. Pat. No. 4,729,481 granted Mar. 8, 1988 for "Apparatus For Advancing Shelved Goods."

Certain dairy products, such as cottage cheese, yogurt and, particularly, ice cream, are packed in cylindrical containers and, of course, displayed in refrigerated compartments. Such containers are more generally displayed in a plurality of cylindrical stacks, with their flat sides in supporting engagement. In the event of a front-opening refrigerated compartment the stacks may tend to topple and, in the event of an open top freezer chest, it is frequently necessary to unstack and remove several cartons in order to find or choose a particular ice cream flavor.

OBJECTS OF THE INVENTION

It is an object of this invention to provide a merchandise display rack particularly adapted to arrange a row of cylindrical containers on their sides with means to move the row forward on the shelf as the front container is removed.

It is a further object of this invention to provide a display rack assembly for a plurality of cylindrical ice cream containers wherein a row of containers for each flavor is disposed with the cartons on their sides and with the flavor clearly visible from the front.

It is a further object of this invention to provide a display rack assembly, each rack in the assembly to display a row of articles.

Other objects and advantages of this invention will become apparent from the description to follow, particularly when read in conjuction with the accompanying drawing.

SUMMARY OF THE INVENTION

In carrying out this invention, the display rack assembly comprises a plurality of racks, each with in-turned guide rails on which a series of cylindrical containers may be disposed one after the other. Means are provided to join the racks side by side and, stacked vertically with the stacks spaced to accommodate rows of cartons between them. Hence a number of different rows of the cylindrical containers, as for example, different flavors of ice cream, can be displayed on a single freezer shelf with the favor, as marked on the tops, clearly visible. As a container is removed from a particular row, the containers behind it are pushed forwardly to appear at the front of the shelf.

DESCRIPTION OF A PREFERRED EMBODIMENT

Figure 1:
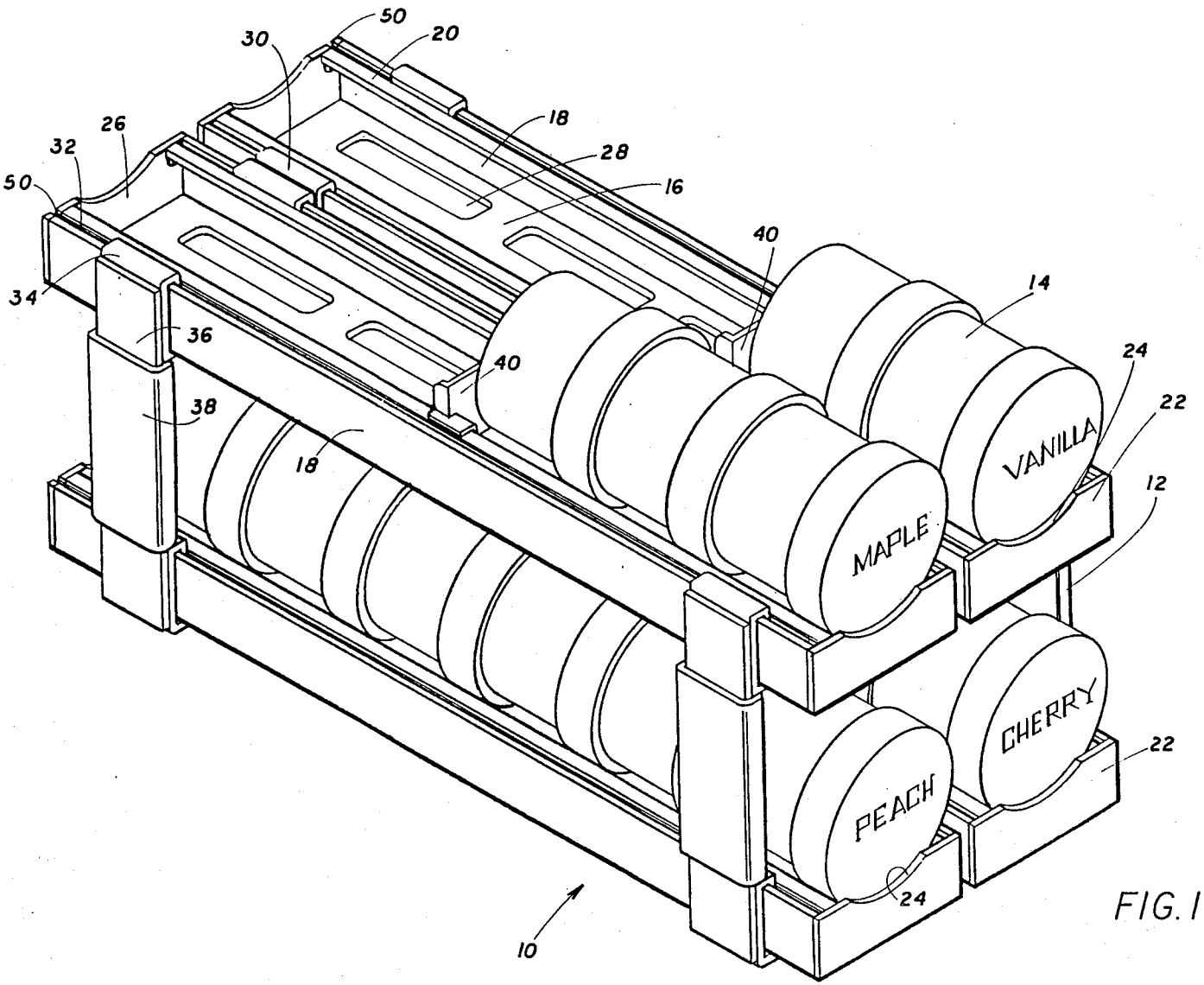
FIG. 1 is a view in perspective showing an assembly of forward feeding cylindrical container racks.

Referring now to the drawings with greater particularity, the rack assembly 10 of this invention comprises a plurality of rack units 12, which are arranged side by side and/or in vertical stacks to form a gang rack assembly for a plurality of rows of merchandise, such as cylindrical ice cream containers 14.

Each basic rack unit has a bottom wall or panel 16, side panels 18 and inturned side rails 20 on which the cylindrical containers 14 are supported for sliding movement progressively forwardly to a front stop plate 22. The front stop plate 22 blocks forward movement of the cylindrical containers 14, but an arcuate cutout 24 facilitates removal of the leading container from the rack side rails 20. A similar back plate 26 is secured to the rear of each basic unit 12. Particularly when used in a freezer compartment, the bottom panel 16 is provided with openings 28 for free circulation of air.

Basic rack units 12 are secured side t side by means of double C-clips 30 that are snapped over the side panels 18 and into grooves 32 formed in the side rails 20 adjacent the side panels 18. Single C-clips 34 are snapped over the outer side panels 18 for stacking basic racks 12, as will be described.

Figure 2:
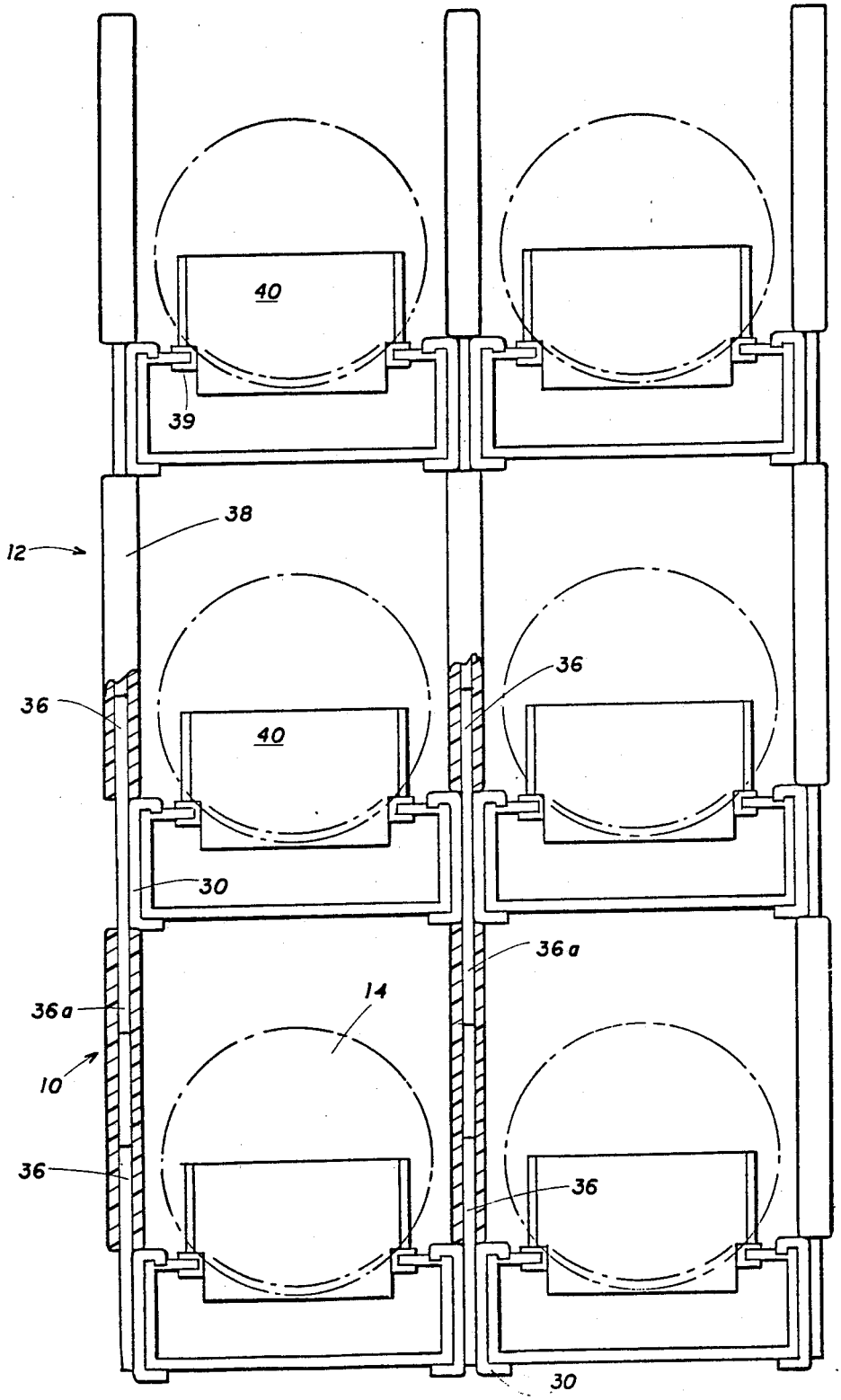
FIG. 2 is a vertical section of a display rack assembly.
Figure 3:
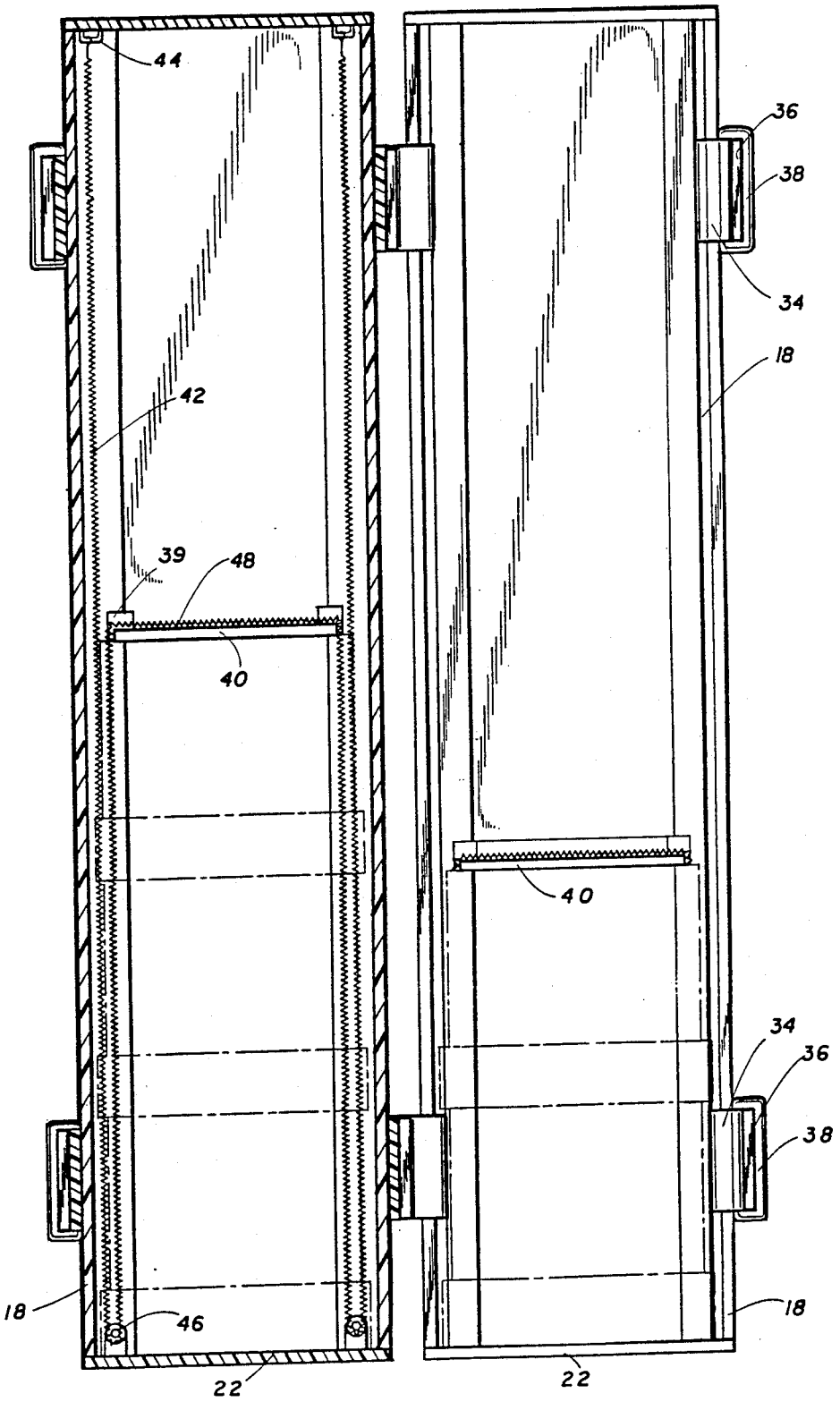
FIG. 3 is a top plan view of merchandise display rack.

Each C-clip 30 and 34 has a flat anchor post 36 extending therefrom to be received in a flat, tubular post 38 that separates one basic rack from a basic rack 12 above it. As noted particularly in FIG. 2, there are four types of interconnecting C-clamps, to wit: a double C-clamp 30 with a single post anchor 36, a double C-clamp 30 with two anchor posts 36 and **36*a*, a single C-clip 34 with a single anchor post 36 and a single C-clip 34 with a double post anchor 36 and 36*a*. Hence, there are a number of ways in which the individual rack units 12** can be arranged side by side and stacked vertically.

Slidably carried on the inwardly extending top guide rails of each rack unit 12 are slide members 39, between which is carried a back pusher plate 40. The back pusher plate 40 is designed to engage behind each row of containers 14 to push the row forward as the leading container is removed, the back pusher plate being driven forward by an elongated, coiled tension spring 42.

Secured to each side of the back stop plate 26 is an anchor member 44 to which the ends of the elongated spring 42 are fixed. The spring extends forwardly from each side of the anchor plate, under the in-turned side rails 20 and over and around pulleys 46, which are secured to the front stop plate 22. From the pulleys, the mid-portion 48 of the coil spring 42 extends around the back pusher plate 40 to bias it forwardly under a continuous spring force.

It will be noted that, with the rack assembly 10 of this invention, the cylindrical ice cream containers 14 can be arranged in neat rows, extending front to back in a freezer compartment. The markings on the top of the container usually indicating the flavor of the ice cream packed within, are clearly visible from the front of the assembly, and each leading container in a row thereof is close to the front of a shelf (not shown) on which it is displayed and readily accessible for removal. It should also be noted that each back stop plate 26 is notched at 50 (FIG. 1) in alignment with the elongated groove 32 so that a basic rack unit 12 can be grasped by the front stop plate 22 and slidably removed from the C-clips 30 and 34 for cleaning. After cleaning, the rack unit 12 is slidably replaced in the nature of a drawer.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A display rack for merchandise in containers comprising:

a slideway having a bottom panel, narrow upright side panels and inwardly directed side rails at the tops of said side panels;

said slideway having a front end and a rear end;

said side rails being spaced apart a distance to support a container;

a pair of pulleys at the front end of said slideway, each disposed adjacent one of said side panels;

an elongated, stretchable, thin, coiled tension spring secured at opposite ends thereof to the rear ends of said slideway;

said tension spring extending forwardly along one of said side panels, around both of said pulleys and back along the other of said side panels so that any extending and contracting movements of said tension spring are facilitated by said pulleys a push plate;

a pair of outwardly disposed channel-like slide members carried on said push plate and slidably received on said side rails; and mutually engageable stop means on said push plate and the front end of said slideway;

the portion of said tension spring between said pulleys extending slidably across the back of said push plate and free of attachment thereto.

2. The display rack defined by claim 1 wherein:

said channel-like slide members are of substantial length and are closely received on said side rails to slide smoothly therealong without skewing.

3. The display rack defined by claim 1 including:

a front plate secured to cover the space between said side panels;

said front plate being engageable by a container pushed forward on said side rails;

said pulleys being secured to said front plate to extend rearward therefrom.

4. The display rack defined by claim 1 including:

top and bottom grooves in the top of each side rail and in the bottom of each bottom panel parallel to and along each of said side panels;

a pair of C-clips engaged over each of said side panels at the front and rear thereof;

said C-clips having inwardly directed lips along the open edges thereof received in said top and bottom grooves;

a first flat post anchor on each of said C-clips extending upward therefrom;

a channel-like post slidably received over each of said post anchors;

front and rear upper C-clips with depending second post anchors received in the top of each of said channel-like posts to receive the side panels of a second slideway between them.

5. A display rack for merchandise comprising:

a slideway having a bottom panel, narrow upright side panels and inwardly directed side rails at the tops of said side panels;

a pair of pulleys at the front end of said slideway, each disposed adjacent one of said side panels;

an elongated, stretchable tension member secured at opposite ends thereof to the rear end of said slideway;

said tension member extending forwardly along both of said side panels and around said pulleys;

a push plate slidably carried on said slideway between said side rails;

mutually engageable stop means on said push plate and the front end of said slideway;

said tension member extending across the back of said push plate;

top and bottom grooves in the top of each side rail and in the bottom of each bottom panel parallel to and along each of said side panels;

a pair of C-clips engaged over each of said side panels at the front and rear thereof;

said C-clips having inwardly directed lips along the open edges thereof received in said top and bottom grooves;

a first flat post anchor on each of said C-clips extending upward therefrom;

a channel-like post slidably received over each of said post anchor;

front and rear upper C-clips with depending second post anchors received in the top of each of said channel-like posts to receive the side panels of a second slideway between them.

6. The display rack defined by claim 5 including:

a pair of outwardly disposed channel members of substantial length carried on said push plate and positioned to be slidably received on said side rails without skewing.

7. The display rack defined by claim 5 wherein said tension member comprises:

a long, thin coiled tension spring.

8. A display rack for merchandise comprising:

a slideway having a bottom panel, narrow upright side panels and slide rails at the top of said side panels;

said slideway having a front end and a rear end;

a pair of pulleys at the front end of said slideway, each disposed below one of said slide rails;

an elongated, thin, stretchable, coiled tension spring secured at opposite ends thereof to the rear end of said slideway;

said tension spring extending forwardly along both of said side panels and around said pulleys, so that any extending or contracting movements of said tension spring are facilitated by said pulleys;

a push plate;

a pair of channel members of substantial length carried on said push plate positioned to be slidably received on said slide rails without skewing; and mutually engageable stop means on said push plate and the front end of said slideway;

the mid-portion of said tension member extending from said pulleys back and slidably across the back of said push plate.

* * * * *